United States Patent [19]

Sitaramiah

[11] 4,430,408

[45] Feb. 7, 1984

[54] DEVELOPING POWDER COMPOSITION CONTAINING A FLUORINE-MODIFIED ALKYL SILOXANE

[75] Inventor: George G. Sitaramiah, St. Paul, Minn.

[73] Assignee: Minnesota Mining and Manufacturing Company, St. Paul, Minn.

[21] Appl. No.: 392,063

[22] Filed: Jun. 25, 1982

[51] Int. Cl.[3] ..... G03G 9/14

[52] U.S. Cl. ..... 430/106.6; 430/109; 430/903

[58] Field of Search ..... 430/106.6, 109, 110, 430/903

[56] References Cited

U.S. PATENT DOCUMENTS 3,558,492 1/1971 Proskow ..... 430/106.6

3,652,315 3/1972 Matsuo et al. ..... 430/106.6

4,265,993 5/1981 Kawanishi et al. ..... 430/106.6

FOREIGN PATENT DOCUMENTS 56-39553 4/1981 Japan .

*Primary Examiner*—John E. Kittle

*Assistant Examiner*—John L. Goodrow

*Attorney, Agent, or Firm*—Donald M. Sell; James A. Smith; James V. Lilly

[57] ABSTRACT

Developing powder compositions containing a fluorine-modified alkyl siloxane and a surface treatment of carbon black are disclosed. The toner powders exhibit reduced sensitivity to machine conditions and provide copies whose images are sharply defined, have substantially reduced image fill-in, substantially reduced backgrounding, and good image density.

24 Claims, No Drawings

DEVELOPING POWDER COMPOSITION CONTAINING A FLUORINE-MODIFIED ALKYL SILOXANE

FIELD OF THE INVENTION

This invention relates to monocomponent (or one part) developing powder compositions (referred to herein as toner powders) useful in electrographic copying processes. More particularly, it relates to dry heat-fusible and pressure-fixable toner powders that have a fluorine-modified alkyl siloxane dispersed therein and carbon black attached to the surface thereof.

BACKGROUND ART

Developing powder compositions employing fluorine-modified silicone oils have been suggested. See Japanese KOKAI 39553 (published Apr. 15, 1981) which discloses a toner composition comprising a mixture of thermoplastic resin, magnetic powder, and fluorine-modified silicone oil. This toner composition is said to possess improved flowability and offsetting characteristics. In spite of such claims of improved characteristics, such compositions exhibit poor sensitivity to changes in the developing gap utilized during image development. Consequently, more stringent process parameters, such as narrow doctor blade gap, must be employed.

Additionally, such compositions do not exhibit good image acuity, particularly in terms of edge sharpness and "fuzzy fill-in" (i.e., unwanted deposition of toner powder particles in letters such as "A", "a", "B", "b", "e", "O", "o", "P", "p", etc.).

DISCLOSURE OF THE INVENTION

The present invention provides a mono-component toner powder composition made up of a plurality of discreet particles each of which comprises (a) from about 40 to 70 (preferably from about 40 to 45) weight percent thermoplastic binder selected from the group consisting of (i) polyester resins, and (ii) copolymers of styrene monomers and a monomer selected from at least one acrylate or methacrylate monomer, (iii) a wax component having a melting point in the range of from about 45° C. to 150° C., and (iv) a blend of said wax component and a thermoplastic organic resin wherein the weight ratio of said wax component to said thermoplastic organic resin is in the range of from about 1:0.2 to 1:1;

(b) from about 30 to 60 (preferably from about 54 to 58) weight percent of a magnetically responsive material dispersed in said binder;

(c) from about 0.05 to 2 (preferably from about 0.2 to 0.5) weight percent of a fluorine-modified alkyl siloxane dispersed in said binder; and (d) from about 0.005 to 0.3 (preferably from about 0.05 to 0.1) weight percent of carbon black attached to the exterior surface of the particles.

The toner powder of the present invention is less sensitive to changes in the size of the developing gap utilized than are previously known toners which employ fluorine-modified silicone oils. Thus, there is less decrease in image density as the gap is widened with the instant toners than with such previously known toners. This permits the use of more generous process conditions so that machine tolerances such as doctor blade gap may be relaxed. Thus, the toner powders of the invention are particularly useful in recording processes such as are described in U.S. Pat. No. 4,121,931 to Nelson. They are also useful in other recording processes such as that disclosed in U.S. Pat. No. 3,816,840 to Kotz.

The powder of the invention also produces final images with sharply defined edges, substantially reduced "fuzzy fill-in", and substantially reduced background. Still further, the density of images produced from toner powders of the invention is good even in high humidity environments.

The present invention also provides toner powders which possess a less positive triboelectric characteristic with respect to selenium. This aids in providing high image quality in processes employing selenium based photoconductors.

The reduction in sensitivity to changes in the gap latitude and the improvements in copy quality achieved with toners of the invention are due to the use of both the fluorine-modified alkyl siloxane dispersed in the binder of the particles and the surface treatment of carbon attached to the exterior surface of the particles. While the exact mechanism by which this improvement occurs is not known, it has been found that the elimination of either of these elements results in a toner powder which fails to provide the advantages of the invention.

It has also been found that the amounts of the fluorine-modified alkyl siloxane and the surface-attached carbon black employed is critical to the invention. Thus, levels of less than about 0.05 weight percent of the siloxane do not provide any noticeable improvement in image quality. Levels of more than about 2 weight percent of the siloxane result in a toner which is too soft and causes offsetting during fusing. Levels of less than about 0.005 weight percent of surface-attached carbon black do not provide any noticeable improvement in image quality. Levels of more than about 0.3 weight percent of surface-attached carbon black result in toner powders having too high a dynamic conductivity. Such toner powders produce low quality images, particularly in high humidity environments.

DETAILED DESCRIPTION

The toner powder composition of the invention preferably has a dynamic conductivity of less than about three microamperes. Dynamic conductivity simulates the electrical conductivity of a toner powder during use in electrographic copying processes. Low dynamic conductivity is indicative of a resistive surface on the toner powder particles. Resistive surfaces are conductive to better transfer at high humidity. It is additionally preferred that the toner powder of the invention comprise particles wherein at least 95 number percent thereof have a maximum dimension in the range of about 4 to 30 microns.

The fluorine-modified alkyl siloxane useful in the present invention comprises a material having a siloxane backbone with alkyl groups pendent from the silicon atoms. Preferably, the alkyl groups contain from one to about four carbon atoms and are at least partially fluorinated. Most preferably the terminal carbon of the alkyl group is fully fluorinated. One specific example of a useful fluorine-modified alkyl siloxane is FS-1265 available from Dow Corning Corporation. This material is a liquid trifluoropropylsiloxane having the recurring unit

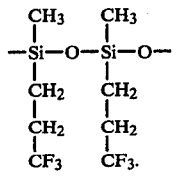

Other trifluoropropyl siloxanes may also be used. They can be liquid or solid materials. Liquid siloxanes may have viscosities in the range of 300 to 10,000 centistokes.

The carbon black which is attached to the surface of the toner powder particles may be either conductive or resistive. Typically, the individual particles of carbon black have an average diameter below about 100 millimicrons and most preferably below about 40 millimicrons. The carbon black is attached to the exterior surface of the toner powder particles so that essentially all of the carbon black particles protrude from the individual particles of toner powder. An occasional carbon black particle may, however, be embedded completely. The resulting surface-attached layer of carbon black may be continuous or discontinuous. The process for attaching the carbon black, described more fully hereinafter, results in physical attachment to the surface of the particles.

In addition to employing surface-attached carbon black, the present invention may also employ carbon black dispersed within the binder. In this embodiment of the invention the individual particles of toner powder contain carbon black dispersed throughout the particle and carbon black attached to the surface of the particles. Essentially all of the carbon black dispersed throughout the binder is completely embedded in the toner powder particles so that no more than an occasional particle of this carbon black protrudes. Up to about 5 percent by weight carbon black may be dispersed in the binder.

Representative examples of useful carbon blacks include "Vulcan" XC-72R, a conductive carbon black with a maximum particle size of 30 millimicron sold by Cabot Corporation; "Conductex" 950, maximum particle size of 21 millimicron sold by Cities Service; "Raven" 5750, maximum particle size of 17 millimicron sold by Columbia Chemicals; and "Thermax" MT sold by R. T. Vanderbilt.

The thermoplastic binder employed in the present invention is selected from the group consisting of (i) polyester resins, (ii) copolymers of monomers of styrene and one or more acrylate or methacrylate monomers, (iii) a defined wax component, and (iv) a blend of said defined wax component and a thermoplastic organic resin. Toner powder compositions which utilize binders (i) and (ii) are heat-fusible while those which utilize binders (iii) and (iv) are pressure-fixable.

Polyester resins useful in the present invention are thermoplastic materials and are known. They may be prepared by, for example, reacting a desired dicarboxylic with a polyhydroxy composition. Techniques and reactants for such reactions are known.

Representative examples of useful polyester resins include poly(ethylene terephthalate), poly(ethylene sebacate), poly(diethylene glycol terephthalate), poly(1,2-propylene terephthalate), poly(hexamethylene sebacate), polypropylene glycol adduct of bisphenol-A condensed with carboxylic acids such as terephthalic acid, isophthalic acid, and phthalic acid, and copolymers of such acids with propylene glycol and the like. Examples of such polyesters include diphenyl ether fumarate, bisphenol-A phthalate, propylglycol bisphenol-A phthalate, propylglycol bisphenol-A terephthalate, ethylene glycol terephthalate, propylene glycol terephthalate, bisphenol-A fumarate, and propoxylated bisphenol-A fumarate, such as Atlac®-382ES available from ICI Americas Inc. This material has the recurring unit

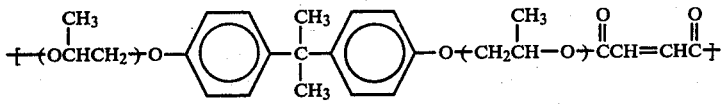

and has a $T_g$ of 50° C., a melt index (105° C./2160 g) of 14±4, and a 15 second tack point of 75° C.

Representative examples of useful copolymers of styrene monomers and one or more acrylate or methacrylate monomers include copolymers of styrene and n-butylmethacrylate, styrene and 2-ethylhexylacrylate, and styrene and 2-ethylhexyl methacrylate. Specific examples of such copolymers include Ionac ®X-231 (65 weight % styrene and 35 weight % n-butylmethacrylate); Ionac ®X-279 (75 weight % styrene and 25 weight % 2-ethylhexyl acrylate), and Ionac ®X-296 (75 weight % styrene and 25 weight % 2-ethylhexyl methacrylate). The Ionac® materials are available from Ionac Chemical Company. Other such copolymers include ORG-D0018 (75 weight % styrene and 25 weight % n-butylacrylate, available from Hercules Chemical Company).

Examples of waxes useful in the binder include aliphatic waxes (natural or synthetic), fatty acids, metal salts of fatty acids, hydroxylated fatty acids or amides, and aromatic and polymeric wax-like materials.

Representative useful aliphatic waxes include paraffin wax, microcrystalline wax, caranauba wax, montan wax, ouricury wax, ceresin wax, candellila wax, and sugar cane wax.

Representative useful fatty acids include stearic acid, palmitic acid, and behenic acid. Representative useful metal salts of fatty acids include aluminum stearate, lead stearate, barium stearate, magnesium stearate, zinc stearate, lithium stearate, and zinc palmitate. Representative amide hydroxy waxes include N(betahydroxyethyl)-ricinoleamide (commercially available under the trade name "Flexricin 115"), N,N'ethylene-bis-ricinoleamide (commercially available under the trade name "Flexricin 185"), N(2-hydroxyethyl)-12-hydroxystearamide (commercially available under the trade name "Paracin 220"), and N,N'-ethylene-bis-12-hydroxystearamide (commercially available under the trade name "Paracin 285").

Representative fatty acid derivatives include castor wax (glyceryl tris-12-hydroxy stearate), methyl hydroxy stearate (commercially available under the trade name "Paracin 1"), ethylene glycol monohydroxy stearate (commercially available under the trade name "Paracin 15") and hydroxy stearic acid.

Representative useful aromatic wax-like materials include dicyclohexylphthalate, diphenylphthalate and the Be Square series of waxes from the Bareco Division of Petrolite Corporation, such as Be Square 195. The Be Square waxes are high melting point waxes that consist of paraffins and naphthenic hydrocarbons.

Thermoplastic organic resins useful in the blend preferably have a ring and ball softening point above about 60° C. Examples of useful thermoplastic organic resins include polyamide resins, polyester resins, epoxy resins, acrylic resins, copolymers of styrene and acrylate and methacrylate monomers, vinyl resins, polyvinyl acetate, vinyl copolymers, ethylene/vinylacetate copolymers, cellulose esters, and cellulose acetate propionate.

Other useful thermoplastic organic resins include ethylene homopolymers such as the low molecular weight polyethylenes available from the Bareco Division of Petrolite Corporation (e.g, Polywax 655, 1000, and 2000). Other useful ethylene homopolymers include oxidized, high density, low molecular weight polyethylenes such as Polywax E-2018 and E-2020 sold by Bareco Division of Petrolite Corporation. Still other useful low molecular weight polyethylene resins are the Epolene® series of resins such as Epolene®N-14 available from Eastman Chemical Products Incorporated.

The magnetically responsive material employed in the toner powder composition is dispersed (preferably homogeneously) throughout the binder. Additionally, it preferably has an average major dimension of one micron or less. Representative examples of useful magnetically responsive materials include magnetite, barium ferrite, nickel zinc ferrite, chromium oxide, nickel oxide, etc The toner powders of the invention may be readily prepared. For example, heat-fixable toners may be prepared by dry blending the thermoplastic organic resin, the magnetically responsive material, the fluorine-modified alkyl siloxane and any carbon black which is to be dispersed throughout the binder in a suitable vessel. The dry blend is then melt mixed with heat until a homogeneous molten mixture is obtained. This mixture is allowed to cool and then ground to form coarse particles which are then classified to obtain the desired particle size distribution. The classified particles are then treated with the surface-applied carbon black by adding the particles and the carbon black to a suitable vessel and mixing the ingredients at a temperature in the range of from about 45° to 60° C. Typically, this is accomplished within about 3 hours. The resultant toner powder is then cooled, screened to remove agglomerates, and reclassified so that the product is in the desired particle size range.

Optionally, the classified coarse particles may be momentarily subjected to high temperatures (e.g, 450° C.–600° C.) prior to surface attachment of the carbon black. This processing step provides particles whose surfaces are substantially free of sharp edges. It also preferably essentially spheoridizes at least 40 number percent of the particles. The remainder of the particles can comprise any body having rounded edges. It has been found that toner powders which have been made in a process which utilizes this processing step demonstrate better flow properties than do those made by processes which do not employ this step.

Momentarily subjecting the coarse particles to high temperatures may be accomplished by aspirating them into a moving gas stream, preferably air, thereby creating an aerosol. The aerosol is directed at an angle of about 90°±5° through a stream of gas, again preferably air, which has been heated to between about 450° C and 600° C. into a cooling chamber where the particles are allowed to settle by gravity as they cool.

Pressure-fixable toner powders may be prepared by, for example, heating the materials of the binder to melting, and then mixing the magnetically responsive material, fluorine-modified alkyl siloxane and dispersed carbon black (if present) with the melted binder materials until a homogeneous dispersion is obtained. The temperature of the dispersion is then raised to about 190° C. and the dispersion sprayed through a nozzle at the rate of about 90 kg/hr to form discrete particles. The particles are cooled and classified in the desired particle size. The particles are then combined with the surface treatment carbon black by adding both to a blender at ambient temperature and mixing for about 12 hrs. The particled are then passed through a zone of air heated to about 200° C. at a rate of about 40 g/min.

The present invention is further illustrated by means of the following examples wherein the terms parts refers to parts by weight unless otherwise indicated. In these Examples certain physical properties of the toner powders have been measured. The techniques for measuring these properties are now described.

a. Dynamic Conductivity is measured on a device made up of the developing section of a "Secretary III" photocopier (available from the 3M Company) that has been modified to utilize a 12.5 cm diameter aluminum drum in place of the normal photoconductor drum. The developer roll of the device comprises a stainless steel shell (3.15 cm diameter) around an 8 pole circular magnet. A doctor blade, a toner hopper, and a 1000 volt power supply are also supplied. The gap between the developer roll and the aluminum drum is set at 0.071 cm. The gap between the doctor blade and the toner hopper is set at 0.05 cm. The gap between the toner hopper and the developer roll is set at 0.125 cm.

To measure dynamic conductivity, 16 ml of toner is added to the hopper and the device is started so that the developer roll and the aluminum drum are driven in opposing directions. The developer roll is driven at a surface speed of 61.3 cm/sec and the aluminum drum is driven at a surface speed of 19.5 cm/sec. The device is run for five minutes after which the current passing through the toner while it is in the development gap and under a 1000 volt potential is measured.

b. Triboelectric Characteristic is measured on a device comprising a selenium coated photoconductive drum (15 cm diameter), a developer roll (3 cm diameter) which comprises a stainless steel shell around a circular magnet (800 gauss) and a doctor blade which operates in connection with the developer roll. The gap between the doctor blade and the toner is set at 0.04 cm and the gap between the developer roll and the photoconductive drum is set at 0.055 cm. A 15 ml beaker is filled with toner powder and the toner is then poured evenly across the length of the developer roll along the doctor blade. The device is started so that the developer roll and the photoconductive drum rotate toward each other. The developer roll rotates at a speed of 360 rpm and the photoconductive drum rotates at a speed of 25 rpm. After one minute, the current passing through the toner while it is in the gap between the developer roll and the photoconductive drum and under the voltage generated by the mixing of toner powder is determined. The polarity of that current is also determined.

c. Gap Latitude measures the sensitivity of a toner powder to changes in the size of the development gap. Generally speaking, the density of an image produced from a given toner powder decreases as the size of the development gap increases. Thus the larger the gap, the lower the resultant image density. Larger differences indicate that the toner powder is more sensitive to such changes and, therefore, provides optimum results only at narrower development gaps.

Gap latitude is measured from a copy of step 41 of the gray scale on a conventional electrographic recording device (e.g., a "Secretary III") as follows. The development gap is reduced to the point at which image densities on an imaged and developed photoconductive surface vary horizontally between bands of high and low image density across the photoconductive surface. The development gap is then opened by turning the adjustment means two full turns from this point. A copy is produced at this opening and its image density measured using a conventional diffuse reflection densitometer such as a MacBeth Quanta-Log Diffuse Reflection Densitometer, Model RD-100. The development is then further opened another 0.01 cm. A copy is produced at this opening and its image density measured as described above. The gap latitude is the difference in image density between the two development gap settings.

EXAMPLE 1

A series of heat fusible toner powders according to the invention was prepared from the following ingredients:

| Ingredient | Parts | | | | | | |
|---|---|---|---|---|---|---|---|
| | A | B | C | D | E | F | G |
| Bisphenol-A Fumarate Polyester (Atlac ®-382ES available from ICI Americas Incorporated) | 43.9 | 43.9 | 43.8 | 43.9 | 43.9 | 43.8 | 44 |
| Magnetite (available from Cities Service Corporation) | 54.7 | 54.6 | 54.6 | 54.7 | 54.6 | 54.6 | 54.8 |
| Dispersed Carbon Black (Raven 5750 available from Columbia Chemicals) | 1 | 1 | 1 | 1 | 1 | 1 | 1 |
| Fluorine-Modified Alkyl Siloxane (FS-1265 Available from Dow Corning Corporation) | 0.2 | 0.2 | 0.2 | 0.2 | 0.2 | 0.2 | 0.2 |
| Surface-Attached Carbon Black (Raven-5750) | 0.15 | 0.3 | 0.45 | — | — | — | 0.05 |
| Vulcan XC-72R available from Cabot Corporation) | — | — | — | 0.15 | 0.3 | 0.45 | — |

The polyester, magnetite, dispersed carbon black, and siloxane were dry blended at room temperature (i.e., 19° C.) for about 3 hrs. The mixture was then heated and agitated until the polyester resin melted and a homogeneous dispersion of the ingredients obtained. The dispersion was then allowed to cool and solidify after which the solidified composition was broken into coarse particles and reduced to fine powder of particles using a hammer mill and an air jet mill. The resultant particles were then classified to obtain the desired particle size.

The carbon black was attached to the surface of the particles by mixing both the particles and the carbon black in a blender at a temperature of about 50° C. for about 4 hrs.

The resultant toners were tested for dynamic conductivity, triboelectric characteristic, and gap latitude. The results of these tests are given in Table 1.

TABLE 1

| | A | B | C | D | E | F | G |
|---|---|---|---|---|---|---|---|
| Dynamic Conductivity (microamperes) | 2.4 | 6.9 | 10 | 1.7 | 3.3 | 4.7 | 1.5 |
| Triboelectric Characteristic (nanoamperes) | 19 | −5.2 | 11 | −22 | 33 | 52 | −76 |
| Gap Latitude | 0.35 | 0.1 | 0.09 | 0.52 | 0.42 | 0.45 | — |

The resultant toner powders were used in a heat-fusing electrographic recording process at ambient conditions in a "Secretary III" copying machine available from 3M Company to provide images on plain paper substrates. Images produced from toner powders A and D-G provided images that were sharply defined and had substantially reduced fuzzy fill-in, that is, the openings in the images (letters) were substantially free from extraneous toner powder particles. Images produced from toner powders B and C had poor edge definition and substantial fuzzy fill-in.

Toners A, C, F, and G were then used in a heat-fusing electrographic recording process in a tropic room maintained at 27° C. and 70% relative humidity. Images produced from toner powders A and G provided images that were sharply defined and had virtually no fuzzy fill-in under the test conditions. Images produced from toners C and F had poor edge definition and substantial fuzzy fill-in under the test conditions.

EXAMPLE 2

A series of pressure-fixable toner powders were prepared using the following ingredients:

| | A | B | C | D |
|---|---|---|---|---|
| Emulsifiable low molecular weight polyethylene (Epolene ® N-14 available from Eastman Chemical Products, Inc.) | 20 | 20 | 20 | 20 |
| Low molecular weight, unmodified homopolymer of ethylene having | 20 | 19 | 20 | 20 |

-continued

| | A | B | C | D |
|---|---|---|---|---|
| Mw/Mn of 1.2 (Polywax 1000 available from Bareco Division of Petrolite Corp.) | | | | |
| Magnetite (K378 available from Northern Pigments Co., Ltd.) | 60 | 60 | 60 | 60 |
| Dispersed Carbon Black | | | | |
| Raven 5750 | 0.5 | — | — | — |
| Vulcan XC72R | — | 2 | — | — |
| FS-1265 | 0.5 | 0.5 | — | 0.5 |
| Surface-Attached Carbon Black (Vulcan XC72-R) | 0.29 | 0.28 | 1.2 | 0.14 |

These toner powders were prepared by heating the Epolene® and Polywax to melting after which the magnetite and dispersed carbon black (if present) were added. Heating and mixing was continued until the homogeneous dispersion of the ingredients was obtained. The temperature of the dispersion was raised to about 190° C. and the dispersion sprayed through a nozzle at the rate of about 91 kg/hr to form discrete particles. The particles were cooled and classified to the desired particle size and surface treated with the carbon black by mixing the two ingredients in a blender at ambient temperature for about 12 hours. The surface-treated toner powders were then fed to an air aspirator in a uniform stream of about 40 grams/min which sucked the particles into an air stream and dispersed them forming an aerosol. The aerosol was directed at 90° into a heated air stream, the temperature of which was maintained at about 200° C. The powder was allowed to settle and was collected by filtration. A flow agent (0.1% by weight Aerosil R-972 available from DeGussa Incorporated) was added to each composition.

The toner powders were tested for dynamic conductivity and triboelectric characteristic. The results of these tests are given in Table 2.

TABLE 2

| | A | B | C | D |
|---|---|---|---|---|
| Dynamic Conductivity (microamperes) | 2.8 | 8.5 | 7.2 | 2.5 |
| Triboelectric Conductivity (nanoamperes) | −10 | −170 | −11 | −35.4 |

The toner powder compositions were used in a pressure-fixing copying process to provide images on a plain paper substrate. Toner powders A and B (examples of the invention) provided copies whose images were sharply defined, had virtually no image fill-in and virtually no backgrounding. Toner powder D (an example of the invention) provided copies whose images were sharply defined, had only slight fuzzy fill-in, and had virtually no backgrounding. Toner powder C, however, (a comparative example) provided a copy whose images had poor edge definition, a high degree of image fill-in and a high degree of backgrounding.

EXAMPLE 3

Example 1 (A-F) was repeated except that no FS-1265 was utilized. The composition of the resulting toner powders and their dynamic conductivities, triboelectric characteristics, and gap latitudes are given in Table 3.

| | Parts | | | | | |
|---|---|---|---|---|---|---|
| | A | B | C | D | E | F |
| Atlac ® 382ES | 43.9 | 43.9 | 43.8 | 43.9 | 43.9 | 43.8 |
| Magnetite | 54.7 | 54.6 | 54.6 | 54.7 | 54.6 | 54.6 |
| Dispersed Carbon Black (Raven 5750) | 1 | 1 | 1 | 1 | 1 | 1 |
| Surface-Attached Carbon Black | 0.15 | 0.3 | 0.45 | | | |
| Raven 5750 | | | | | | |
| Vulcan XC-72R | — | — | — | 0.15 | 0.3 | 0.45 |
| Dynamic Conductivity (microamperes) | — | 6.1 | — | 10 | — | — |
| Triboelectric Characteristic (nanoamperes) | — | 175 | — | 91 | — | — |
| Gap Latitude | | | | | | |

When used as described in Examples 1 and 2, toner powders B and D provided copies whose images had poor edge definition, a high degree of image fill-in, and a high degree of backgrounding.

I claim:

1. A mono-component toner powder composition comprising a plurality of discrete particles each comprising (a) from about 40 to 70 weight percent thermoplastic binder selected from the group consisting of (i) polyester resins, (ii) copolymers of styrene monomers and at least one monomer selected from acrylate and methacrylate monomers, and (iii) a wax component having a melting point in the range of from about 45° C. to 150° C., and (iv) a blend of said wax component and a thermoplastic organic resin, wherein the weight ratio of said wax component to said thermoplastic organic resin is in the range of from about 1/0.1 to 1/1;

(b) from about 30 to 60 weight percent of a magnetically responsive material dispersed therein;

(c) from about 0.05 to 2 weight percent of a fluorine-modified alkyl siloxane dispersed therein; and (d) from about 0.005 to 0.3 weight percent of carbon black attached to the exterior surface thereof so that essentially all of the said carbon black particles protrude from said particles of said toner powder composition.

2. A toner powder composition according to claim 1 further including up to about 5 weight percent carbon black dispersed therein.

3. A toner powder composition according to claim 1 wherein said thermoplastic binder is polyester resin.

4. A toner powder composition according to claim 3 wherein said polyester resin is selected from the group consisting of poly(ethylene terephthalate), poly(ethylene sebacate), poly(diethylene glycol terephthalate), poly(1,2-propylene terephthalate), poly(hexamethylene sebacate), polypropylene glycol adduct of bisphenol-A condensed with carboxylic acids selected from the group consisting of terephthalic acid, isophthalic acid, and phthalic acid, copolymers of propylene glycol and acids selected from the group consisting of terephthalic acid, isophthalic acid, and phthalic acid.

5. A toner according to claim 4 wherein said polyester resin is selected from the group consisting of propylene glycol adduct of bisphenol-A condensed with an acid selected from the group consisting of terephthalic acid, isophthalic acid, and phthalic acid, and copolymers of propylene glycol and acids selected from the group consisting of terephthalic acid, isophthalic acid and phthalic acid.

6. A toner powder composition according to claim 5 wherein said polyester is selected from the group consisting of diphenyl ether fumarate, bisphenol-A phthalate, propylene glycol phthalate, propylglycol terephthalate, ethylene glycol terephthalate, propylene glycol terephthalate bisphenol-A fumarate, and propoxylated bisphenol-A fumarate.

7. A toner powder composition according to claim 6 wherein said polyester resin is propoxylated bisphenol-A fumarate.

8. A toner powder composition according to claim 7 wherein said bisphenol-A fumarate has the recurring unit

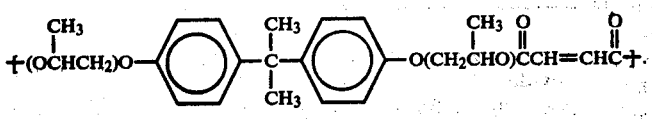

9. A toner powder composition according to claim 1 wherein said thermoplastic binder is a copolymer of styrene monomer and at least one monomer selected from acrylate and methacrylate monomers.

10. A toner powder composition according to claim 4 wherein said copolymer comprises 60 to 80 weight percent styrene and 20 to 40 weight percent n-butylmethacrylate.

11. A toner powder composition according to claim 10 wherein said copolymer is selected from the group consisting of copolymers of styrene with materials selected from n-butylmethacrylate, 2-ethylhexylacrylate, and 2-ethylhexyl methacrylate.

12. A toner powder composition according to claim 11 wherein said copolymer is a copolymer of styrene and n-butylmethacrylate.

13. A toner powder according to claim 12 wherein said copolymer comprises 65 weight percent styrene and 35 weight percent n-butylmethacrylate.

14. A toner powder composition according to claim 1 wherein said thermoplastic binder comprises said wax component.

15. A toner powder composition according to claim 1 wherein said thermoplastic binder comprises said blend of said wax component and said thermoplastic organic resin.

16. A toner powder composition according to claim 1 wherein said fluorine-modified alkyl siloxane comprises a siloxane backbone having alkyl groups pendant from the silicon atom thereof.

17. A toner powder composition according to claim 16 wherein said alkyl groups contain from 1 to about 4 carbon atoms.

18. A toner powder composition according to claim 17 wherein the terminal carbon atom of said alkyl group is fully fluorinated.

19. A toner powder composition according to claim 18 wherein said fluorine-modified alkyl siloxane is trifluoropropyl siloxane.

20. A toner powder composition according to claim 19 wherein said trifluoropropyl siloxane has the recurring unit

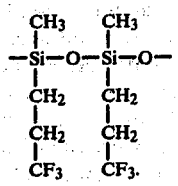

21. A toner powder composition according to claim 1 wherein said individual toner powder particles have surfaces substantially free of sharp edges.

22. A toner powder composition according to claim 21 wherein said toner powder composition comprises at least 40 number percent spheres.

23. A toner powder composition according to claim 1 comprising from about 40 to 45 weight percent of said thermoplastic binder, from about 54 to 58 weight percent of said magnetically responsive material, from about 0.2 to 0.5 weight percent of said fluorine-modified alkyl siloxane, and from about 0.05 to 0.1 weight percent of said carbon black attached to the exterior surface of said particles.

24. A composition according to claim 1 containing from about 0.2 to 0.5 weight percent of said fluorine-modified alkyl siloxane.

* * * * *